US011619057B2

(12) United States Patent
Wallner

(10) Patent No.: US 11,619,057 B2
(45) Date of Patent: Apr. 4, 2023

(54) MODULAR SWIMMING POOL

(71) Applicant: Michael Wallner, Herrnberg (AT)

(72) Inventor: Michael Wallner, Herrnberg (AT)

(73) Assignee: WSN HOLDING GMBH, Schwertberg (AT)

( * ) Notice: Subject to any disclaimer, the term of this patent is extended or adjusted under 35 U.S.C. 154(b) by 0 days.

(21) Appl. No.: 17/594,587

(22) PCT Filed: Apr. 22, 2020

(86) PCT No.: PCT/AT2020/060161
§ 371 (c)(1),
(2) Date: Oct. 22, 2021

(87) PCT Pub. No.: WO2020/215110
PCT Pub. Date: Oct. 29, 2020

(65) Prior Publication Data

US 2022/0127869 A1 Apr. 28, 2022

(30) Foreign Application Priority Data

Apr. 25, 2019 (AT) ..... A 50379/2019

(51) Int. Cl.
*E04H 4/00* (2006.01)

(52) U.S. Cl.
CPC ..... *E04H 4/0043* (2013.01)

(58) Field of Classification Search
USPC ..... 4/506
See application file for complete search history.

(56) References Cited

U.S. PATENT DOCUMENTS 3,419,917 A 1/1969 Schankler

OTHER PUBLICATIONS

International Preliminary Report on Patentability received for PCT Patent Application No. PCT/AT2020/060161, dated Nov. 4, 2021, 15 pages (6 pages of English Translation and 9 pages of Original Document).
International Search Report issued in application PCT/AT2020/060161 dated Aug. 28, 2020.
Written Opinion issued in Application PCT/AT2020/060161 dated Aug. 28, 2020.

*Primary Examiner* — Christine J Skubinna
(74) *Attorney, Agent, or Firm* — Workman Nydegger

(57) ABSTRACT

A modular swimming pool with one or more swimming pool modules that each include a floor element, and a wall element connected to the floor element. The swimming pool modules by assembly define an internal pool space. The floor element and the wall element of a swimming pool module have reinforcement ribs and the reinforcement ribs of the wall element extend towards the floor element. The reinforcement ribs are spaced apart from each other and on the external surface form open chambers configured, when resting on a mounting surface, to be completely filled with a binder. The internal pool space in the area of the floor element has a wedge-like recess, forming a continuous duct area of the internal pool space, and the reinforcement ribs of the floor element are connected to an external surface of the recess, which faces away from the duct area, thereby restricting the open chambers.

11 Claims, 8 Drawing Sheets

MODULAR SWIMMING POOL

The present application is a U.S. National Stage of International Application No. PCT/AT2020/060161, filed on Apr. 22, 2020, designating the United States and claiming the priority of Austrian Patent Application No. A50379/2019 filed with the Austrian Patent Office on Apr. 25, 2019. All of the aforementioned applications are incorporated herein in their respective entireties by this reference.

The invention relates to a modular swimming pool, which comprises at least a first and a second swimming pool module, wherein each swimming pool module has a floor element as well as at least one wall element connected to the floor element, wherein the swimming pool modules by assembly define an internal pool space, wherein the floor element and the wall element of at least one swimming pool module have reinforcement ribs raising from the external surface on an external surface of the swimming pool module, which faces away from the internal pool space, wherein the reinforcement elements of the wall element, which are arranged spaced apart from each other at a distance, extend towards the floor element. The wall elements of the modular swimming pool, furthermore, may have transverse ribs, which are oriented essentially perpendicular to the reinforcement ribs extending towards the floor element.

The invention further relates to a method for the installation of such a modular swimming pool.

There is essentially distinguished between two types of swimming pools: swimming pools installed within the soil and swimming pools installed above-ground on a subsurface. The invention disclosed herein preferably relates to a swimming pool installed within the soil, wherein the swimming pool may also be provided for the installation above ground.

There is further distinguished between swimming pools consisting of a single part and modular swimming pools assembled from several pre-fabricated modules. Assembling the modules may be realized in the fabric or on the installation site, for example, by means of bonding, welding or screwing.

With modular swimming pools, which are assembled on the installation site, there are given several advantages in comparison to swimming pools consisting of only one part.

On the one hand, in order to transport common single-part swimming pools, there are often required, depending on the size of the swimming pool, complex measures, which not infrequently may require the use of cranes, long trucks or also helicopters. With modular swimming pools, however, transport to the installation site may be carried out in a much more simple and flexible way, for example, using conventional trucks or transporters, due to the advantageous dimensions of the individual modules.

On the other hand, the modules, due to their much lower weight as well as their much smaller size in comparison to single-part swimming pools, may be unloaded much more easily at the installation site or mounted in poorly accessible plots, respectively, in particular if the modules are made from plastic material. Furthermore, in the case of built-in swimming pools, it is possible to better compensate for unevenness of the subsurface, on which the swimming pool rests, due to the modular configuration, as during installation every single module is able to carry out any possible corrections in order to ensure horizontality of the pool edge.

The patent application US2014/0173820 A1 discloses a modular swimming pool, which is provided for placement above ground. The swimming pool has a floor element and at least one side element, and it is made from a polymer, glass fibre or any similar suitable material. The swimming pool has on the side surfaces of the modules as well as on the lower side of its floor surface several reinforcement elements raising from the surfaces, which will increase stability and resilience of the construction.

When already known modular swimming pools are installed within the soil, the modules frequently have to be placed on a base provided within the soil in advance, in particular a concrete base. This method has several disadvantages. On the one side, the production of the concrete base requires a lot of time, usually approximately twenty-five days, as the concrete has to fully harden before the modules can be placed upon the base. On the other side, in the case of unevenness of the hardened base, post-processing may be necessary by applying a levelling compound, which, in turn, is time consuming and expensive.

Hence, the task of the invention is to provide a modular swimming pool as well as a method for installing the swimming pool, which prevent the disadvantages of prior art. This task is solved by providing a modular swimming pool having the features of claim 1 as well as a method for installing the modular swimming pool having the features of claim 10.

The modular swimming pool according to the invention has reinforcement ribs of the floor element, which are arranged spaced apart from each other at a distance and on the external surface of the swimming pool module form open chambers, which are configured, when the reinforcement ribs rest on an essentially flat mounting surface, to be completely filled with a binder, wherein the internal pool space in the area of the floor element has at least one, in particular wedge-like, recess, which forms a continuous duct area of the internal pool space, wherein the reinforcement ribs of the floor element are connected to an external surface of the recess facing away from the duct area, which restricts the open chambers. The mounting surface may, depending on the type of swimming pool, be in the case of installation within soil, for example, a pit floor that may be covered by a subbase made from stone chips, foam glass or any other suitable materials, or in the case of positioning above-ground, for example, a terrace stone floor or any other suitable subsurface. The external surface of the floor element in the area of the reinforcement ribs thereof is essentially completely covered by the open chambers. Due to the configuration as an open chamber it is possible to inject the binder into the cross-section formed by the floor element, the reinforcement ribs and the mounting surface using a suitable injection device, for example, a foam can. It is also possible to apply the binder directly at the cross-section using a hose transporting the binder and intended for a single use. In this way, there is given the advantage that all open chambers of the lower side of the floor of the swimming pool may be completely filled with the binder when installing the swimming pool, wherein thereby also cavities outside of the open chambers may be filled completely with the binder. In this way, the filled chambers and cavities will provide additional stability and resilience to the lower side of the pool floor of the pool construction. Furthermore, due to the wedge-like recess at the pool floor there is formed a duct, in which the tubing or the supply and discharge of the pool water may be installed, which may ensure a uniform flow of the pool water, wherein the duct is provided with a grid for a subsequent covering in order to separate the tubing from the residual internal pool space. An alternative use of the duct is that particles from water impurities or any other undesired objects such as sand or leaves may accumulate from all over the floor area within the duct, which is why the pool floor will be easy to clean. By the wedge-like recess extending in the middle of the swimming pool, the reinforcement ribs terminate at the external surface of the pool flor at the recess and form open chambers accessible from opposite wall elements on either side of the recess for the injection of binder.

This solves the problem of modular swimming pools according to prior art, in which the reinforcement elements on the lower side of the pool floor will become crumbly and brittle over the course of time due to the weight force applied by the pool water onto the floor as well as due to mechanical stress and weather-conditioned factors such as strong temperature fluctuations and changes of the weather conditions. In this way, the construction decreases in stability and resilience. Aware of the invention, the person skilled in the art could have optionally been able to reduce this effect by introducing a binder into the chambers of the pool floor. As, however, in the modular swimming pool known from the US 2014/0173820 A1 there are configured a plurality of the chambers, this is the chambers situated in the centre, as closed chambers, which cannot not be injected with the binder from the cross-section defined above, this would not have been possible with the modular swimming pools known.

According to a preferred embodiment of the modular swimming pool the first swimming pool module has a technical facilities section separated by at least one wall element from the internal pool space, in which there may be integrated directly into the module technical devices, e.g. pump and filter systems, which are required for the operation of the swimming pool.

According to a further preferred embodiment of the modular swimming pool the open chambers of the floor element may be filled with binder via a closable opening of the recess, wherein the opening will be closed after filling. In this way, the floor elements of the swimming pool modules may be connected to each other in an especially easy way, wherein after connecting the modules through the binder, the opening are closed in a water-tight way, e.g. by welding.

A further preferred embodiment of the modular swimming pool envisages that the wall element has a spillway having an essentially U-shaped cross-section. In this way, pool water splashing over may be received by the spillway and returned, for example, via the technical devices in the technical facilities section to the internal pool space.

According to a further preferred embodiment at least one wall element is connected to at least one support element, in particular to a carbon mesh, a glass mesh fabric or a reinforcement, wherein the space between the wall element and the support element is preferably filled with a binder. In this way, there is given the advantage that the swimming pool may better resist pressure, which is applied, due to the higher resilience of the pool wall.

A further preferred embodiment of the modular swimming pool envisages that the binders suitable for filling the chambers comprise a functional foam, in particular polyurethane foam (PUR foam) or polyiscocyanurat foam (PIR foam). It is thus possible to spray commercially available functional foam, which in comparison to concrete has a significantly shorter hardening time, e.g. approximately one day, onto the open chambers of the lower side of the pool floor. The functional foam may be configured as a functional two-component foam, wherein the components for processing the foam may be mixed directly at the mounting site. Especially preferably, there is chosen the type of the PUR foam or PIR foam, which enables the matching injection depth for injecting into the open chamber or the matching viscosity of the binder in the liquid state, respectively, for applying the binder via a hose in order fill it completely with the functional foam and ensure strength and flexibility over a long service life of the swimming pool.

According to a further preferred embodiment the swimming pool modules are made from a glass fibre-reinforced plastic material, carbon fibres or a plastic of the group of the polyolefins, in particular polypropylene or polyethylene. In this way, there is given the advantage that the swimming pool may be easily machined by suitable cutting means, for example a mill, and the modules furthermore may be produced easily in variable forms by fabrication using CNC milling.

A further preferred embodiment envisages that the floor element and/or at least one wall element have an essentially curved gradient. In this way, there is given the advantage that the swimming pool may be provided in an open geometry, there is, for example, also possible a round or oval shape of the swimming pool, wherein any other shape is possible with the curved gradient of the floor or the wall.

According to a further preferred embodiment at least one open chamber of the floor element has at least one closable opening along the floor element to fill the at least one open chamber with binder and to close the at least one opening after filling. As such the binder may be advantageously injected using a suitable injection device into the cross-section formed by the floor element, the reinforcement ribs and the mounting surface to completely fill it with a binder, if the cross-section has a width that is a multiple of the maximum injection width of the injection device. Depending on the size of the chamber, there may also be provided several openings along the floor element of the open chamber.

The inventive method for installing the modular swimming pool comprises excavating a pit in the soil for forming a mounting surface as well as preferably applying a subbase on the pit floor, positioning two or more swimming pool modules on the mounting surface, joining the swimming pool modules and fixing the swimming pool on the mounting surface by filling the chambers of the floor elements with binder. The method further comprises filling the spaces between the pit and the external surface of the internal pool space with bulk material and/or with binder, in particular with soil, and filling the internal pool space with water, wherein by filling there is formed a pool water surface within the internal pool space. In this way, there is given the advantage that the open chambers directly resting on the mounting surface may be connected by binder to the mounting surface and, hence, the swimming pool may be installed on the installation site much faster and with much less effort, as neither a concrete base nor any similar pre-fabricated base is necessary for installation. Thus, the installation of the swimming pool is much more cost and time efficient in comparison to modular swimming pools of prior art.

According to a preferred embodiment the method comprises, following fixing of the swimming pool, arranging a marking means, in particular a laser beam, which may, for example, be projected by a cross line laser, within the internal pool space, wherein the marking means forms a marking line on the wall element, which is horizontally oriented in the area of the upper edge of a wall element. The preferred embodiment of the method further comprises cutting off the wall elements using a cutting means, in particular a mill, along the marking line for forming a pool water line, at which the wall elements end and transition into the spillway. In this way, there is given the advantage that it is possible to create a pool wall, which forms a flat spillway towards the pool water surface, which is why the water spilling over evenly spills into the spillway.

The invention is now explained in greater detail in reference to the drawings by way of embodiment examples.

Figure 4A:
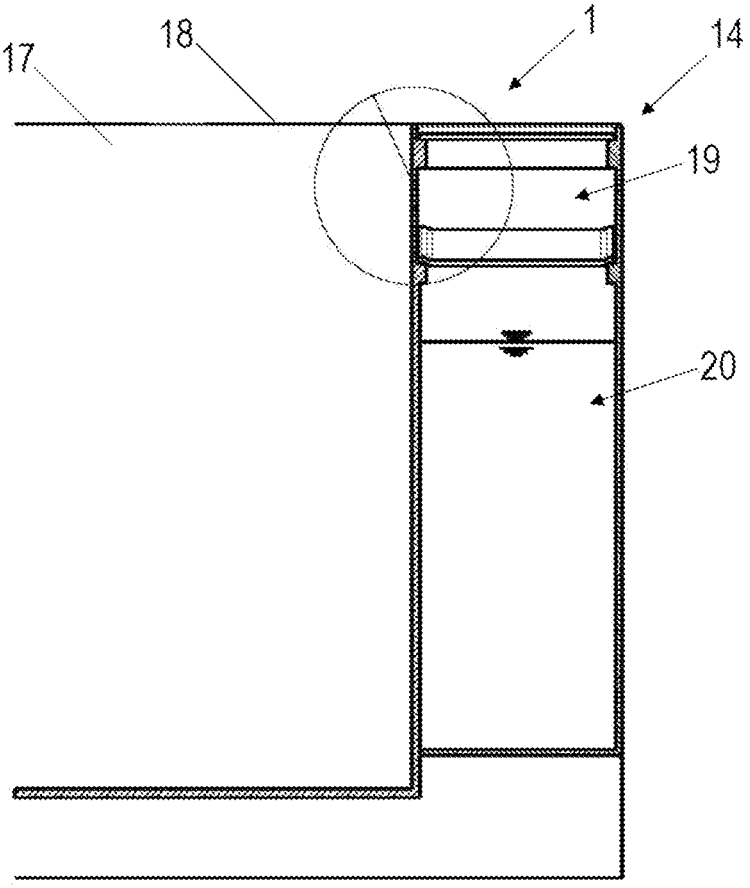

FIG. 4*a* shows a sectional illustration of an installed modular swimming pool having a spillway according to an embodiment variant of the invention, which is filled with water.

Figure 4B:
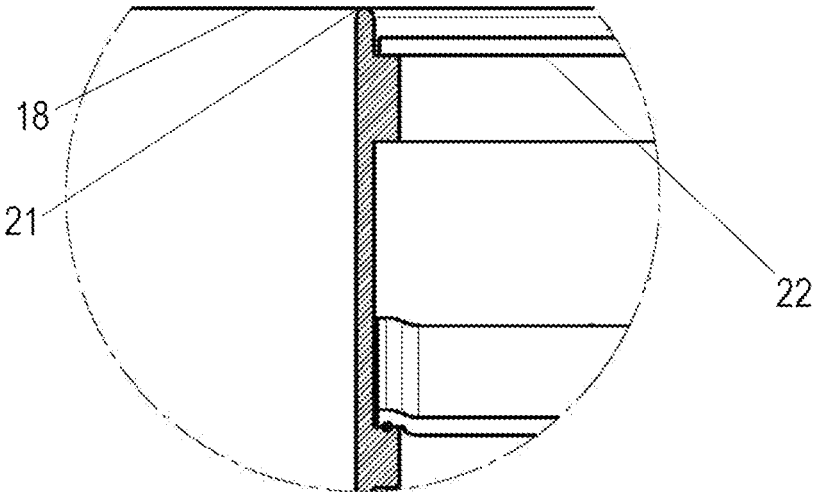

FIG. 4*b* shows an enlargement of a wall area of the swimming pool of FIG. 4*a*.

Figure 5:
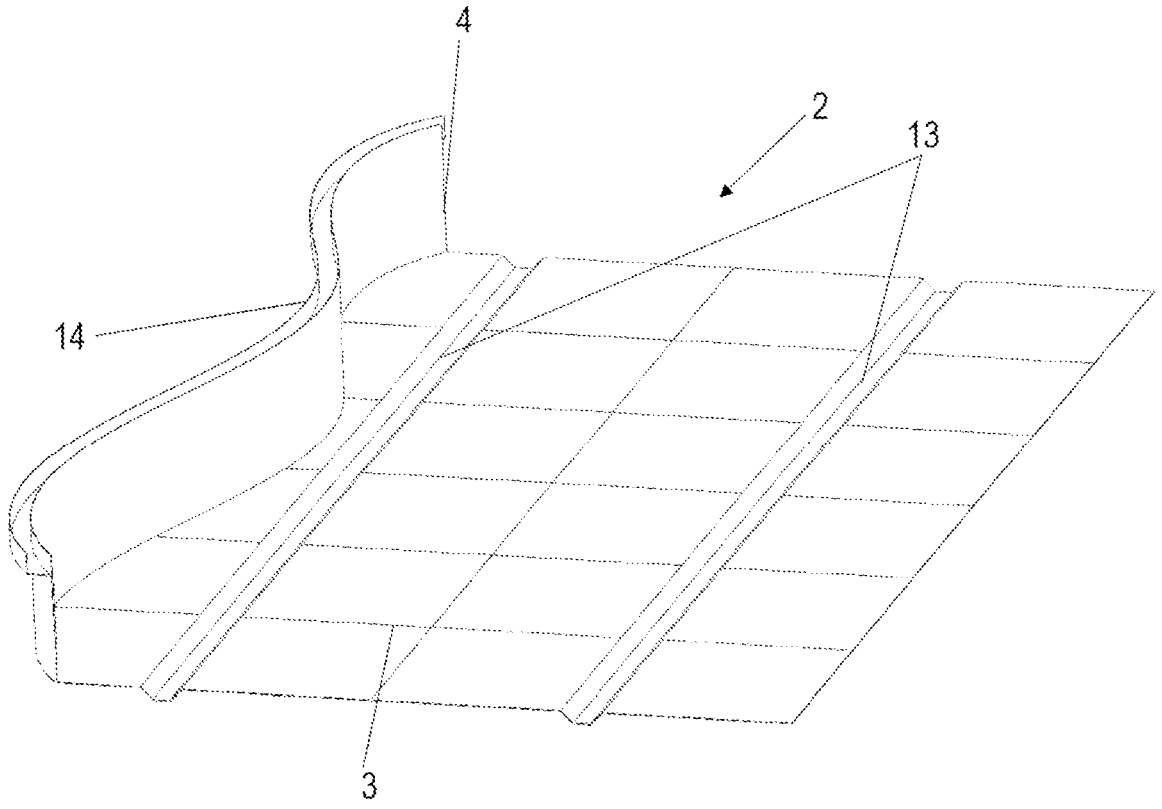

FIG. 5 shows another isometric view of a module of a modular swimming pool according to an embodiment variant of the invention.

Figure 6:
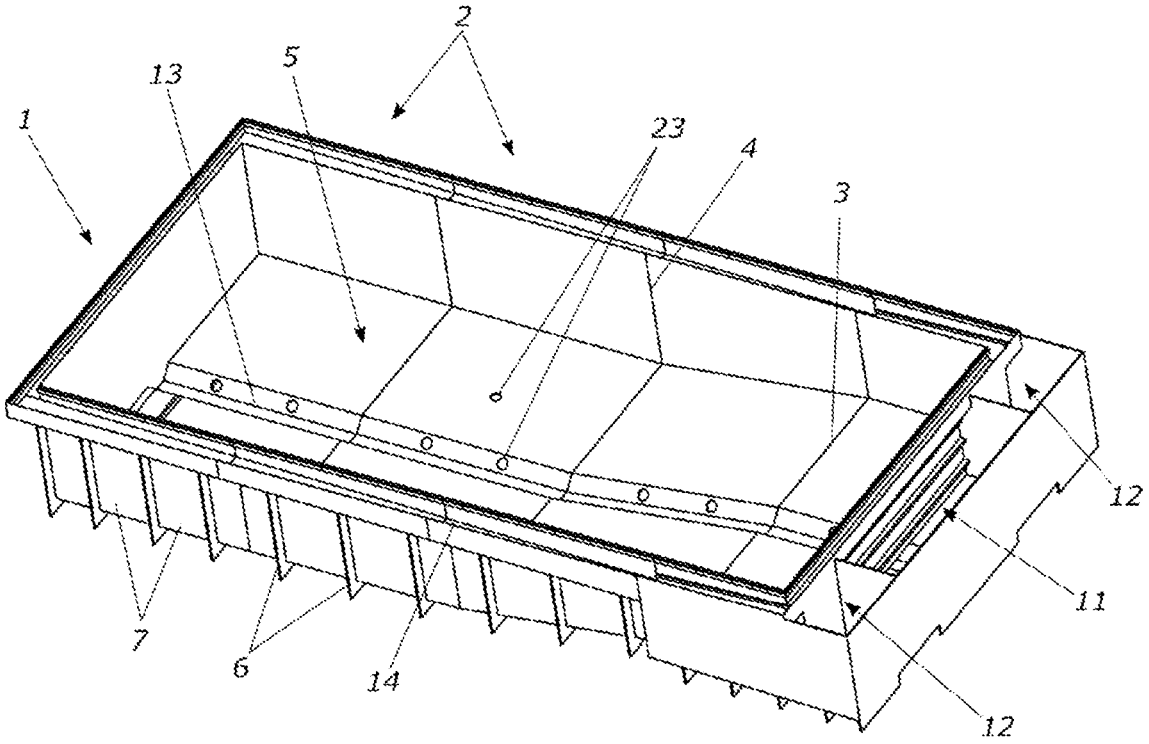

FIG. 6 shows an isometric view of a modular swimming pool according to a further embodiment variant of the invention in the assembled state.

Figure 7:
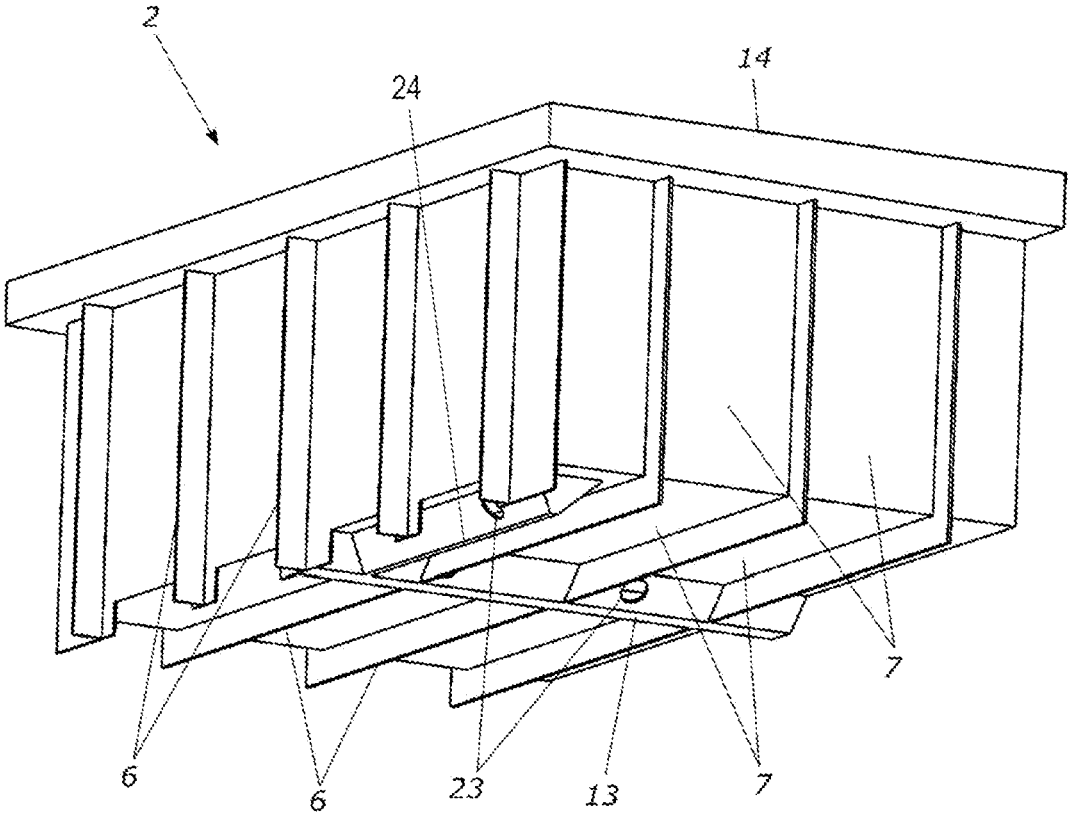

FIG. 7 shows an isometric view of the underfloor of a modular swimming pool according to a further embodiment variant of the invention.

Figure 8:
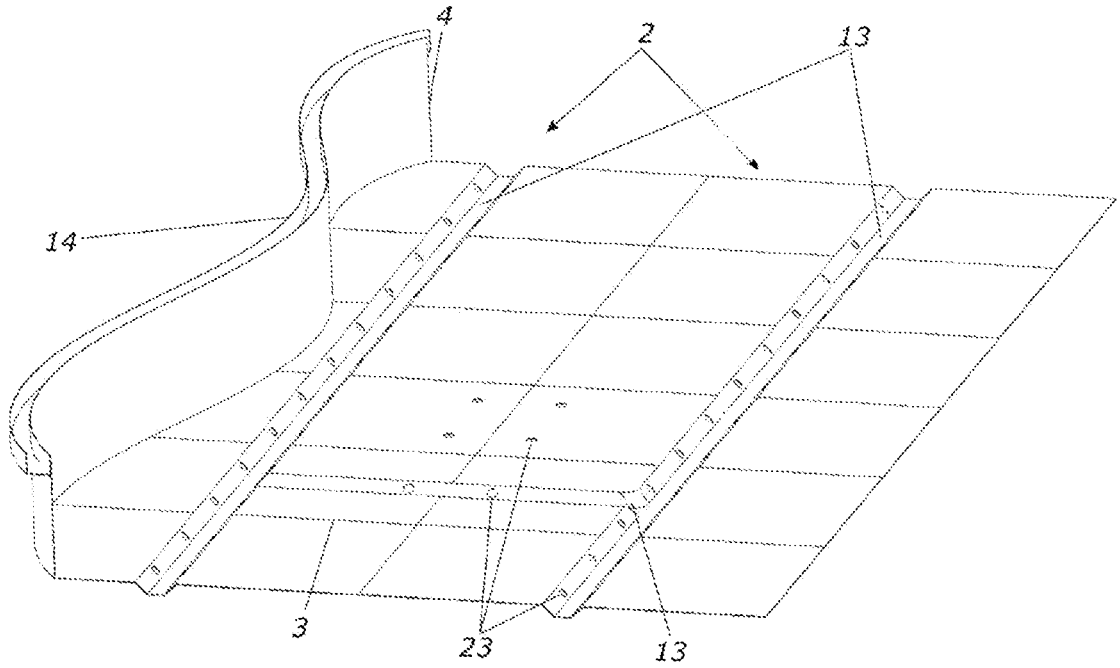

FIG. 8 shows an isometric view of a module of a modular swimming pool according to another embodiment variant of the invention.

Figure 1:
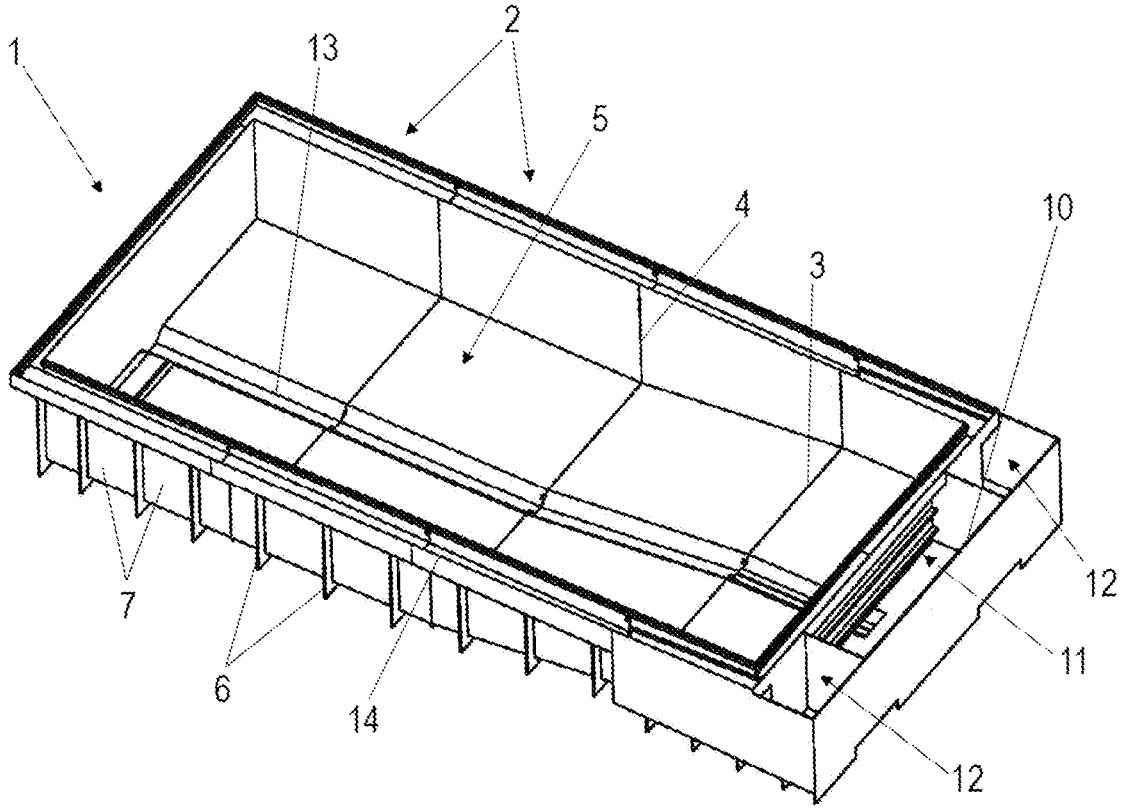
FIG. 1 shows an isometric view of a modular swimming pool according to an embodiment variant of the invention in the assembled state.

FIG. 1 shows a modular swimming pool 1 according to an embodiment variant of the invention, which has several swimming pool modules 2. Each swimming pool module 2 has a floor element 3 as well as at least a wall element 4, wherein the swimming pool modules 2 by assembly form an internal pool space 5, as is clearly visible in FIG. 1. The swimming pool modules 2 further have reinforcement ribs 6 at their external surface facing away from the internal pool space 5. These reinforcement ribs 6 raise from the external surface of the swimming pool modules 2 and are arranged spaced apart from each other at a distance, wherein the reinforcement ribs 6 extend along the wall elements 4 towards the floor elements 3 and the reinforcement ribs 6 of the floor elements 3 essentially completely pass through the floor elements 3, which will be discussed in further detail by way of FIG. 2. The reinforcement ribs 6 form open chambers 7 on the wall element 4 and the floor element 3, wherein the open chambers 7 of the floor elements 3 essentially completely cover the external surface of the floor element 3 and are configured to be completely filled with a binder 8 when resting on a mounting surface 9.

The modular swimming pool 1 in FIG. 1 further has as a first swimming pool module 2 a technical facilities section 10, which is separated by a wall element 4 from the internal pool space 5 and has a cavity 11, which is suited to accommodate swimming pool associated devices such as pump and filter facilities. The technical facilities section 10, as depicted in FIG. 1, further may comprise according to an embodiment variant of the invention at least one splash water container 12. The external surfaces of at least one wall element 4 of the technical facilities section 10 further have reinforcement ribs 5 in order to configure the swimming pool module 2 in a mechanically stable manner.

The embodiment depicted in FIG. 1 of the modular swimming pool 1 has a spillway 14 having a U-shaped cross-section, which enables returning the pool water into a filter cycle of the swimming pool 1 via the at least one splash water container 12, which may be positioned in the area of the technical facilities section 10.

Furthermore, each floor element 3 has in the central area thereof a wedge-like recess 13, as is clearly visible in FIG. 1. This recess forms a continuous duct area of the internal pool space 5.

Figure 2:
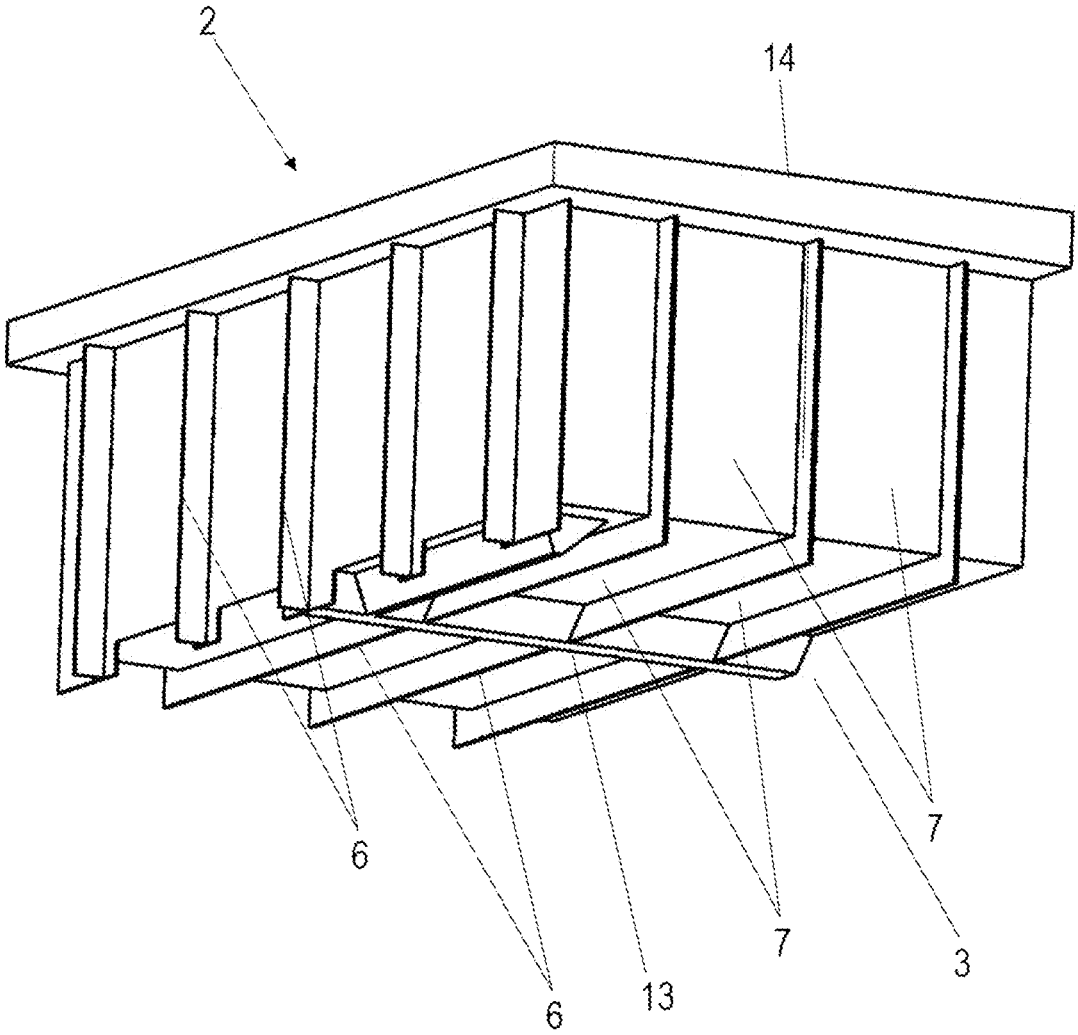
FIG. 2 shows an isometric view of the underfloor of a modular swimming pool according to an embodiment variant of the invention.

FIG. 2 shows the lower side of the pool floor of a swimming element module 2 of a modular swimming pool 1 according to an embodiment variant of the invention. As is clearly visible, the reinforcement ribs 6 form open chambers 7 at the floor element 3 as well as at the wall element 4 of the swimming pool module 2. Furthermore, the reinforcement ribs 6 of the floor element 3, which form the open chambers 7, are connected to an external surface of the recess 13, which faces away from the duct area 13. As can be seen in FIG. 2, the open chambers 7 cover the external surface of the floor element 3 essentially completely and pass essentially completely through the floor element 3. In this way, it is possible, when the swimming pool module 2 rests on a mounting surface 9, to completely fill up the open chambers 7 of the floor element 3 with the binder 8, which is not depicted in the figure. The binders 8 envisaged for filling the chambers 7 comprise a functional foam, in particular a polyurethane foam. Hence, advantageously the requirement of a concrete base, as used with modular built-in swimming pools of prior art, is being dispensed with.

Figure 3:
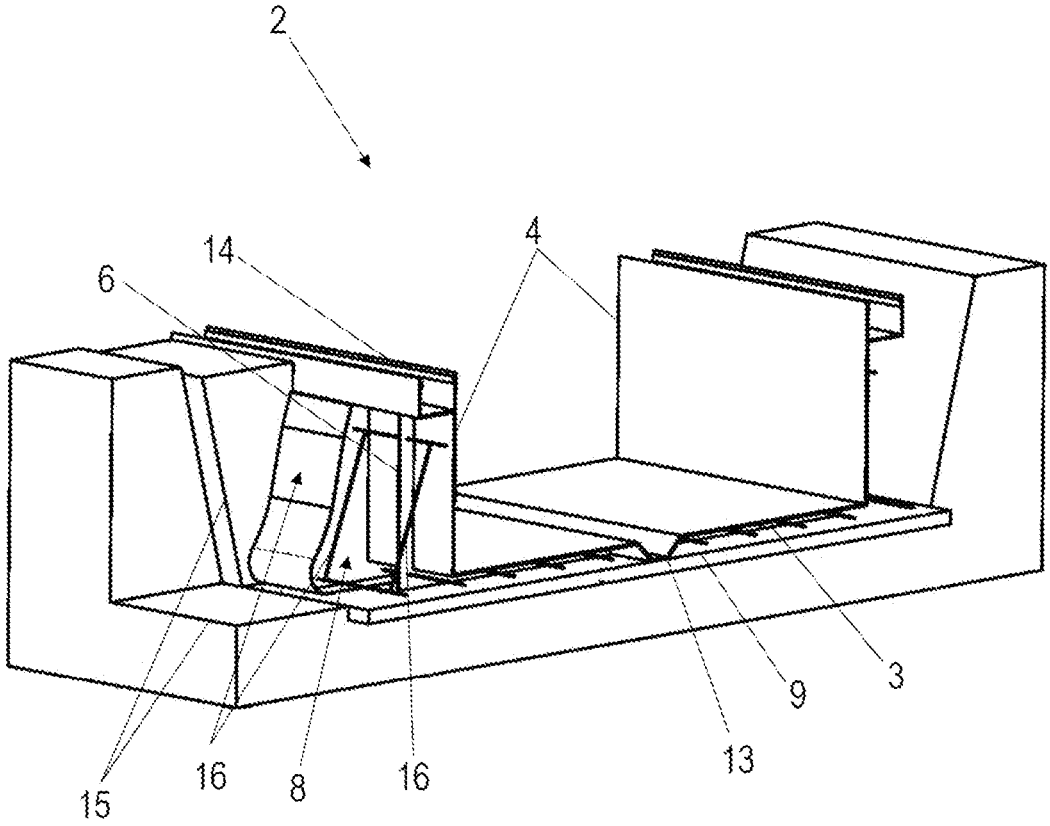
FIG. 3 shows an isometric sectional view of a swimming pool module of an installed modular swimming pool according to an embodiment variant of the invention.

FIG. 3 shows an isometric sectional view of a swimming pool module 2 of an installed modular swimming pool 1 according to an embodiment variant of the invention. The module 2 was positioned according to a method of the invention within the soil 15 on a mounting surface 9 and fixed thereat using binder 8, in particular polyurethane foam. The mounting surface 9 may have a subbase, which may comprise stone chips, foam glass, mineral mixtures with polyurethane binder or other suitable materials. In order to ensure evenness of the module 2 on the subsurface 9, support means, which may be configured as wedges and are not depicted in FIG. 3, may be placed underneath the modules 2. The wall element 4 of the module 2 is connected to a support element 16, which additionally to the reinforcement rib 8 reinforces the wall element 4 and provides the wall element 4 with additional stability and resilience against a pressure applied by water 17 and soil 15 in the assembled state of the swimming pool 1. The support element 16 may, for example, be configured as carbon mesh, glass mesh fabric or also as reinforcement. The space between the wall element 4 and the support element 16 is preferably filled with binder 8. The binders 8, which are envisaged for filling the space, also comprise a functional foam, in particular a polyurethane foam or a polyisocyanurate foam, which renders the construction more stable and resilient against external pressure and internal water pressure.

FIG. 4*a* shows a sectional view of an installed swimming pool 1 having a spillway according to an embodiment variant of the invention, which is filled completely with water 17. Thereby, the water surface 18 constitutes a pool water line. According to the method of the invention a marking means is positioned following the fixing of the swimming pool 1 within the internal pool space 5 in such a way that the marking means, in particular a laser beam, which may, for example, be projected by a cross line laser, forms a marking line, which is oriented horizontally in the area of the upper edge of the internal pool space 5. Then the wall elements 4 of the swimming pool modules 2 are separated by a suitable cutting means, for example a mill, such that wall elements 4 will end along this pool water line of the water surface 18. In FIG. 4*b* it is clearly visible that the upper end of a pool wall, which is designated as pool head 21 and is formed by cutting off the wall element 4 using the cutting means, ends at the pool water line. By such creating an even spillway, the water 17 may enter via a cover 22 the spillway space 13 and, consequently, the splash container space 20 of the splash water container 12, from where it may then be returned into the water cycle of the swimming pool 1.

FIG. 5 shows an isometric view of a segment of a modular swimming pool 1 according to an embodiment variant of the invention, wherein the wall element 4 as well as the spillway 14 of the swimming pool module 2 have a curved shaped. In this way, there is made possible an open geometry of the swimming pool 1. Thus, the entire swimming pool 1 may have an, for example, essentially oval or round shape, and also the floor elements 3 and/or the wall elements 4 of individual swimming pool modules 2 may have a curved shape, whereby there are enabled manifold variants of the pool design. Furthermore, by fabricating the individual swimming pool modules 2 from a plastic material, for example from polypropylene or polyethylene, the various shapes of the swimming pool modules 2 may be produced in the fabric by means of CNC milling methods in a simple and cost-efficient manner.

FIG. 6 shows a modular swimming pool 1 according to another embodiment variant of the invention, which has several swimming pool modules 2. The open chambers 7 of the swimming pool modules 2 have, along the floor elements 3 as well as in the recess 13, a plurality of closable openings 23. By means of these closable openings 23, the open chambers 7 may be filled with binder 8, wherein the openings 23 will be closed after filling with the binder 8. Closing the openings 23 may, for example, be realized by welding the openings 23, wherein welding may be carried out, for example, by heating the front faces of the openings 23 and, consequently, grouting the front faces of the openings 23 using a closure.

FIG. 7 shows a lower side of the pool floor of a swimming pool module 2 of a modular swimming pool 1 according to another embodiment variant of the invention. As illustrated in FIG. 7, the openings 23 may be situated at any location of the recess 13. There may be provided, for example, an opening 23, on the external surface, which faces away from the duct area, of the recess 13, which restricts the open chamber 7. Furthermore, there may, for example, be provided an opening 23 in a transverse recess 24 of the recess 13, which is oriented essentially perpendicularly to the recess 13 extending between the pool ends and connected therewith. In particular, the transition between the recess 13 and the transverse recess 24 may have a rounding or bevelling. An opening 23 provided in the transverse recess 24 may be used to supply the pool with fresh pool water or to discharge old dirty pool water from the internal pool space 5.

FIG. 8 shows an isometric view of a segment of a modular swimming pool 1 according to another embodiment variant of the invention. The modules of the modular swimming pool 1 have, along the floor elements 3 as well as within the recess 13, a plurality of openings 23, by means of which binder 8 may be applied for completely filling the open chambers 7. Furthermore, the segment depicted in FIG. 8 of the modular swimming pool 1 has further transverse recesses, which also have openings 23, wherein the number of the openings 23 for completely filling the open chambers 7 with binder 7 will depend on the chamber size of the open chambers 7.

According to another embodiment of the invention not depicted in the figures the modular swimming pool 1 is positioned above-ground on a mounting surface 9, wherein in this variant the wall elements 4 of the swimming pool modules 2 are configured preferably reinforced. In this way, the modular swimming pool 1 may better resist the water pressure onto its wall elements 4. The reinforcement of the wall elements 4 may, for example, be achieved by using materials having high strength and a high coefficient of elasticity, for example, glass fibre-reinforced plastic material or carbon fibres, and/or by using transverse ribs extending perpendicularly to their reinforcement ribs 6 and/or by foaming the chambers 7 thereof and/or by using the support elements 16 already described for FIG. 3.

According to another embodiment variant of the invention not depicted in the figures the floor elements 3 have spacer feet, which are arranged outside of the area of the reinforcement ribs 6 of the floor elements 3 essentially covered by the chambers 7 for supporting the swimming pool 1. In this way, the stability and resilience of the modular swimming pool 1 is increased in floor areas outside of the open chambers 7.

According to another embodiment variant of the invention not depicted in the figures the entire internal pool space of the modular swimming pool could also be formed by only one module, and there could, for example, only be provided one technical facilities section as a technical facilities module proper, which constitutes a second module of the modular swimming pool. Such a swimming pool module could be erected as an entity on a terrace of a house.

According to another embodiment of the invention the open chambers 7 could be restricted instead of by the external surface of the recess 13 also by further reinforcement ribs extending transversally to the reinforcement ribs 6. It would also be possible to restrict the chambers 7 on all four sides by means of reinforcement ribs, whereby there would be developed in the floor element a closed chamber, the cavity of which could be filled towards the soil via one or several openings 23 within the floor element.

The invention claimed is:

1. A modular swimming pool, which comprises at least a first and a second swimming pool module, wherein each swimming pool module has a floor element as well as at least a wall element connected to the floor element, wherein the swimming pool modules by assembly define an internal pool space, wherein the floor element and the wall element of at least one swimming pool module have reinforcement ribs raising from the external surface on an external surface of the swimming pool module facing away from the internal pool space and wherein the reinforcement elements of the wall element, which are arranged spaced apart from each other at a distance, extend towards the floor element, wherein the reinforcement ribs are arranged spaced apart from each other at a distance and on the external surface form open chambers, which are configured, when the reinforcement ribs rest on an essentially flat mounting surface, to be completely filled with a binder, wherein the external surface of the floor element in the area of the reinforcement ribs thereof is essentially completely covered by the open chambers, wherein the internal pool space in the area of the floor element has at least one wedge-shaped recess, which forms a continuous duct area of the internal pool space, wherein the reinforcement ribs of the floor element are connected to an external surface of the recess, which faces away from the duct area, thereby restricting the open chambers.

2. A modular swimming pool according to claim 1, wherein the first swimming pool module has a technical facilities section separated by at least one wall element from the internal pool space, which comprises at least one cavity for a device for purification and circulation of the water in the internal pool space, wherein the external surfaces of at least one wall element of the first swimming pool module have reinforcement ribs.

3. A modular swimming pool according to claim 1, wherein the wall element has a spillway having an essentially U-shaped cross-section.

4. A modular swimming pool according to claim 1, wherein at least one wall element is connected to at least one support element, wherein the at least one support element is a carbon mesh, a glass mesh fabric or a reinforcement, wherein the space between the wall element and the support element is preferably filled with a binder.

5. A modular swimming pool according to claim 1, wherein at least one open chamber of the floor element has a closable opening within the recess to fill the open chamber with binder and to close the opening after filling.

6. A modular swimming pool according to claim 1, wherein the binders suitable for filling the chambers comprise a functional foam, wherein the functional foam is a polyurethane foam or a polyisocyanurate foam.

7. A modular swimming pool according to claim 1, wherein the swimming pool modules are made from glass fibre-reinforced plastics, carbon fibres or a plastic material of the group of the polyolefins, wherein the group of polyolefins is polypropylene or polyethylene.

8. A modular swimming pool according to claim 1, wherein the floor element and/or at least one wall element have an essentially curved gradient.

9. A modular swimming pool according to claim 1, wherein at least one open chamber of the floor element has at least one closable opening along the floor element to fill the open chamber with binder and to close the opening after filling.

10. A method for installing a modular swimming pool according to claim 1, wherein the method comprises the following operations:

excavating a pit in the soil for forming a mounting surface as well as applying a subbase on the pit floor;

positioning two or more swimming pool modules on the mounting surface;

joining the swimming pool modules;

fixing the swimming pool on the mounting surface by completely filling the open chambers of the floor elements with binder; and filling the spaces between the pit and the external surface of the internal pool space with soil and/or with binder.

11. A method according to claim 10, wherein the method, following the fixing of the swimming pool, comprises the following operations:

arranging a laser beam within the internal pool space, wherein the marking means forms a marking line on the wall element, which is horizontally oriented in the area of the upper edge of a wall element; and cutting off the wall elements, using a mill, along the marking line for forming a pool water line, at which the wall elements end and transition into the spillway.

* * * * *